US008267723B2

(12) United States Patent
Hering et al.

(10) Patent No.: US 8,267,723 B2
(45) Date of Patent: Sep. 18, 2012

(54) FLOOR-MOUNTED DOMESTIC APPLIANCE

(75) Inventors: Reinhard Hering, Holzheim (DE); Stephan Lutz, Sontheim (DE); Bruno Reiter, Kösingen (DE); Michael Rosenbauer, Reimlingen (DE); Martin Stickel, Giengen/Brenz (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 127 days.

(21) Appl. No.: 12/313,071

(22) Filed: Nov. 17, 2008

(65) Prior Publication Data

US 2009/0133928 A1 May 28, 2009

(30) Foreign Application Priority Data

Nov. 28, 2007 (DE) ..... 10 2007 057 335

(51) Int. Cl.
*H01R 24/00* (2011.01)

(52) U.S. Cl. ..... 439/660; 439/924.1

(58) Field of Classification Search ..... 439/106, 439/660, 924.1
See application file for complete search history.

(56) References Cited

U.S. PATENT DOCUMENTS

| | | | | |
|---|---|---|---|---|
| 5,120,236 | A * | 6/1992 | Gilbert | 439/133 |
| 5,190,466 | A * | 3/1993 | McVey | 439/304 |
| 5,734,206 | A * | 3/1998 | Keizer et al. | 307/116 |
| 5,876,248 | A * | 3/1999 | Brunker et al. | 439/607.08 |

FOREIGN PATENT DOCUMENTS

| | | |
|---|---|---|
| DE | 1 690 249 | 2/1972 |
| DE | 35 40 135 | 1/1987 |
| DE | 198 24 169 | 12/1999 |

* cited by examiner

*Primary Examiner* — Thanh Tam Le
(74) *Attorney, Agent, or Firm* — James E. Howard; Andre Pallapies

(57) ABSTRACT

A floor-mounted domestic appliance includes an A.C. power connector that supplies the appliance with electric energy, an appliance outlet that corresponds to the A.C. power connector, wherein the appliance outlet comprises a terminal block for establishing an electrically conducting connection to a power supply lead.

24 Claims, 5 Drawing Sheets

FLOOR-MOUNTED DOMESTIC APPLIANCE

BACKGROUND OF THE INVENTION

The invention relates to a floor-mounted domestic appliance having at least one A.C. power connector for supplying it with electric energy from a domestic power supply network.

Floor-mounted domestic appliances are employed for performing domestic tasks such as, for example, cooking, baking, washing, and cleaning, and need electric energy to operate. For being supplied with electric energy, floor-mounted domestic appliances of the kind have an electric power connector that allows an electric connection to be established to a domestic power supply network for supplying electric loads with electric energy.

The floor-mounted domestic appliances can therein be large appliances or, as the case may be, floor-mounted domestic appliances such as, for example, refrigerators, electric ranges, clothes driers, or water-containing floor-mounted domestic appliances such as washing machines or dishwashers.

Particularly, in the case of floor-mounted domestic appliances or, as the case may be, large appliances, instead of having an A.C. power connector plugged into a socket it may be necessary, owing to national regulations, to provide a fixed installation for which permanent wiring is required that is provided, for example, in a junction box of a domestic power supply network for supplying electric loads with electric energy. A floor-mounted domestic appliance of the type intended for a fixed installation accordingly does not have a corresponding A.C. power supply plug but, instead, a terminal block that is located on the front side of a floor-mounted domestic appliance, for example in the region of the base recess where it will be in an easily visible location. During initial power-on or, as the case may be, installation, that means having to duct the individual wires of a power supply lead to the A.C. power connector located in the region of the base recess and securing them there, which action requires a corresponding body posture.

SUMMARY OF THE INVENTION

It is hence an object of the invention to develop floor-mounted domestic appliances in such a way that initial power-on or, as the case may be, installation will be simplified.

The invention proceeds from a floor-mounted domestic appliance having at least one A.C. power connector for supplying it with electric energy from a domestic power supply network.

An object of the invention is achieved by means of an appliance outlet, corresponding with the A.C. power connector, that has a terminal block for establishing an electrically conducting connection to a power supply lead. What is achieved thereby in a surprisingly simple manner is that for establishing contact it will not be necessary to duct individual wires in the power supply lead to the region of the base recess, which action requires a corresponding body posture. The invention will thus simplify connecting a floor-mounted domestic appliance of such type to the A.C. power supply as well initially powering it on.

The A.C. power connector can be a multi-phase appliance connector plug, for instance a three-phase appliance connector plug as used, for example, for electric ranges. It is, though, preferably provided for the A.C. power connector to be embodied as an appliance connector plug, for example as a single-phase appliance connector socket, having three projecting A.C. power connector contacts, embodied as contact blades, for the phase, neutral conductor, and protective conductor. Four or, as the case may be, five freestanding contact blades can be provided in the case of a three-phase A.C. power connector. The contact blades are therein arranged centrally in a socket and are completely enclosed by openings in the appliance connector plug, as is known from, for instance, plugs for non-heating and also heating appliances.

The floor-mounted domestic appliance, in particular the large appliance or, as the case may be, floor-mounted domestic appliance, preferably has a base recess into which a door by means of which a treatment space can be opened moves, in the case of a dishwasher, for example, for opening same. It is therein preferably provided for the A.C. power connector to be located in the region of the base recess, particularly in a region that will be visible on power-on so that a fitter can readily check the connection to the A.C. power supply. The A.C. power connector is therein located especially on the front side, meaning in a region that is accessible and visible to an operator. The A.C. power connector can alternatively also be located on the rear side.

It is preferably provided for the A.C. power connector and appliance outlet to be mutually detachably joined so that the connection can be readily released for installation or repair purposes. For that purpose it is preferably provided for a latch connection to be provided that secures the connection between the A.C. power connector and appliance outlet. The latch connection is preferably embodied as being able to be latched into position and/or released without the aid of tools.

It is further preferably provided for the A.C. power connector to have at least two freestanding contact blades and for the appliance outlet to have a corresponding number of receptacles for the contact blades of the A.C. power connector. Three contact blades for the phase, neutral conductor and protective conductor are provided in the case of a single-phase connector. Four or, as the case may be, five freestanding contact blades can be provided in the case of a three-phase A.C. power connector.

The A.C. power connector is therein preferably embodied for supplying electric energy for electric voltage levels of domestic supply networks for supplying electric energy. The supply voltages can be A.C. voltages of 240 V or, as the case may be, 230 V or 127 V or, as the case may be, 110 V exhibiting the variations of, for example, 5% or 10% that are customary in supply networks.

It is further preferably provided for the A.C. power connector to have data transmission contacts for extra-low electric voltages. The data transmission contacts will thus carry a voltage that is non-hazardous for fitters so that a recessed arrangement of voltage-carrying contacts will not be required here.

The floor-mounted domestic appliance preferably has a controller that is designed for controlling operating sequences and is connected in an electrically conducting manner to the data transmission contacts. The data transmission contacts will thus also allow e.g. program data for controlling operating cycles to be transmitted to the controller of the floor-mounted domestic appliance during production of a floor-mounted domestic appliance, which is to say preprogramming of the controller. Alongside unidirectional data transmission, the data transmission contacts can, though, also allow bidirectional data transmission that will then, for example, allow service personnel to connect to the inventive A.C. power connector a diagnostic device by means of which both control signals or interrogations of a floor-mounted domestic appliance can be transmitted via the data transmission contacts and data relating to error messages or functional interrogations can be transmitted to the diagnostic device via the data transmission contacts.

The data transmission contacts can be located—embodied as, for example, contact pins—in the center of the A.C. power connector. It is, though, preferably provided for the data transmission contacts to be located on the interior side of the A.C. power connector. That arrangement will make it possible to dispense with socket-side recesses into which the data transmission contacts embodied as contact pins are inserted when a connection is made to a domestic supply network.

It is further preferably provided for the data transmission contacts to extend into an opening on the A.C. power connector. It is therein preferably provided for the controller, in particular a printed circuit board thereof, to extend at least in sections into the opening. That will allow a particularly compact structural design with no additional leads. For that purpose it is preferably provided for the printed circuit board of the controller to form, at least in sections, an interior side of the A.C. power connector. A section of the printed circuit board will thus seal the opening in the A.C. power connector. A particularly compact structural design will be possible if the data transmission contacts are located on the printed circuit board of the controller. The data transmission contacts form a section of the A.C. power connector's inner wall that comes into contact with a corresponding outer surface of a matching appliance outlet and in that way establishes a reliable connection that cannot become detached in an undesired manner even as a result of vibrations and oscillations occurring while the floor-mounted domestic appliance is operating.

BRIEF DESCRIPTION OF THE DRAWINGS

The invention is explained below with the reference to a drawing, in which.

DETAILED DESCRIPTION OF EXEMPLARY EMBODIMENTS

Figure 1:
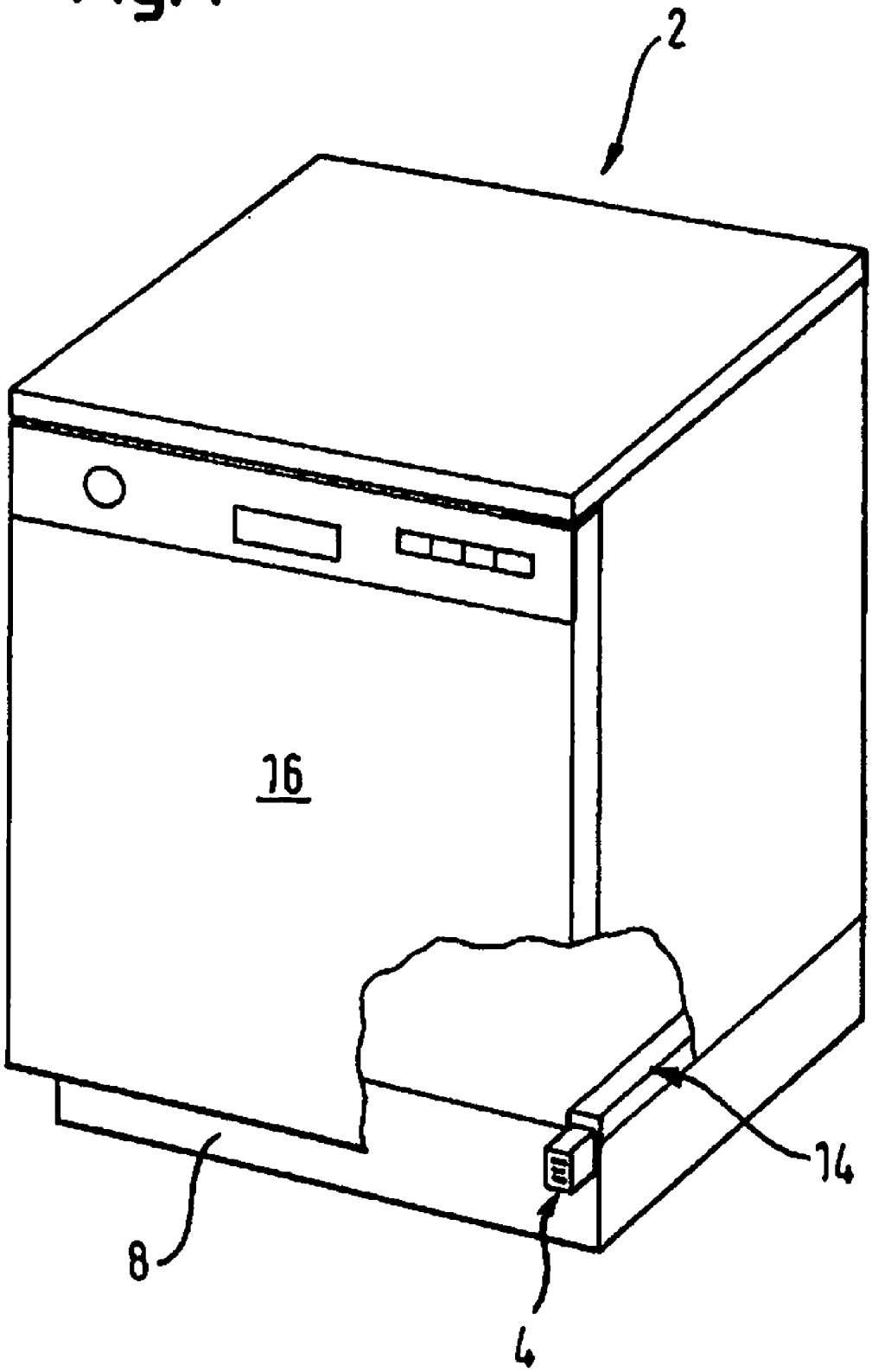
FIG. 1 is a perspective representation of an inventive floor-mounted domestic appliance.
Figure 2:
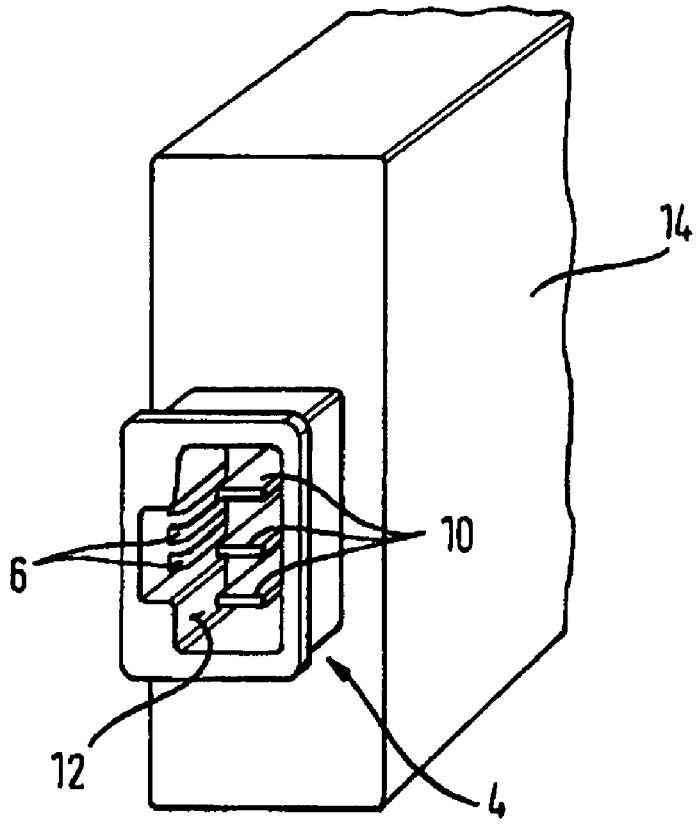
FIG. 2 is a schematic of an A.C. power connector for a floor-mounted domestic appliance.
Figure 3:
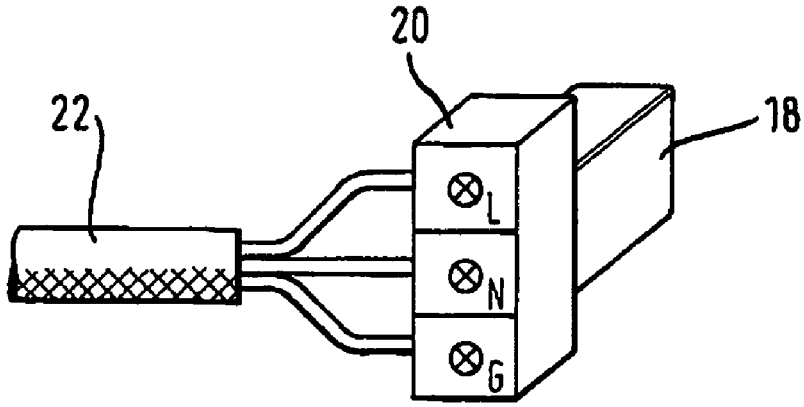
FIG. 3 shows a power supply lead having an appliance outlet and a terminal block.

What is shown is a dishwasher 2 having a door 16 that can be opened in order to expose a treatment space (not shown) into which articles to be washed, meaning crockery in need of cleaning, can be placed. On being opened, the door swivels by a lower section into a free space formed by a base recess 8.

Located in the region of the base recess 8 is the A.C. power connector 4 for supplying the floor-mounted domestic appliance with electric energy. It is therein located on the front side 9 of the floor-mounted domestic appliance 2, meaning on the side easily accessible to an operator. In its installed condition the floor-mounted domestic appliance 2 is therein arranged with its rear side 11 against a wall and laterally flanked by furniture and other appliances.

For executing cleaning programs the floor-mounted domestic appliance 2 has a controller that in turn has, for example, microprocessors and memories (not shown) and is electrically connected to a multiplicity of actuators such as, for example, pumps or detergent-dosing devices as well as a heating means of the floor-mounted domestic appliance 2 to be able to selectively control a desired program cycle. The controller 14 further has an A.C. adapter (not shown) for converting the supply voltage to an internal voltage value.

The A.C. power connector 4 has three freestanding contact blades 10 that are respectively assigned the phase, neutral conductor and protective conductor and by means of which connection is possible to an A.C. power supply for supplying the floor-mounted domestic appliance 2 with electric energy from a domestic power supply network. The A.C. power connector 4 further has data transmission contacts 6 located on an interior side 12 of the A.C. power connector 4. The data transmission contacts 6 are therein not freestanding but integrated in the interior side so that an appliance outlet can be inserted into the A.C. power connector 4 and that will not be impeded by the data transmission contacts 6. In that way it is possible to connect the floor-mounted domestic appliance 2 in a known manner to a domestic supply network for supplying electric energy by means of an A.C. power connector. The transmission contacts themselves will in that case have no function.

Figure 4A:
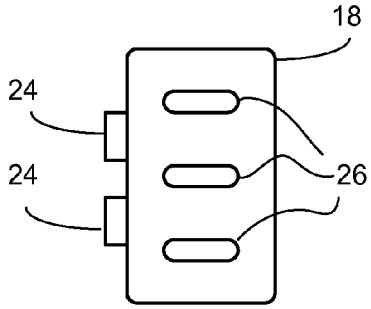
FIGS. 4A-4C shows examples of an appliance outlet socket.
Figure 4B:
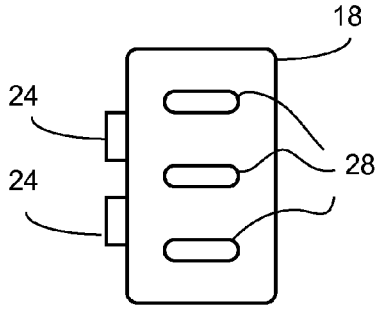
Figure 4C:
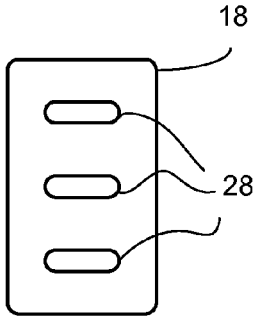
Figure 5:
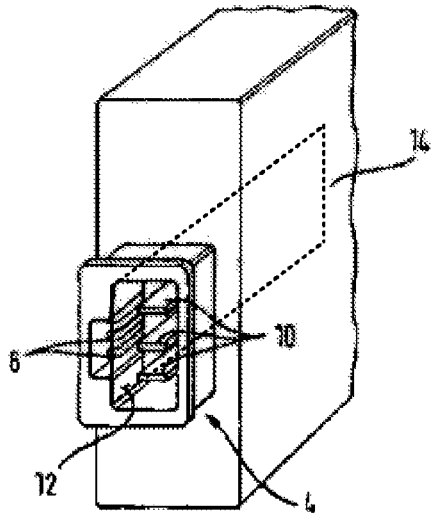
FIG. 5 is a schematic of an A.C. power connector according to another embodiment.
Figure 6:
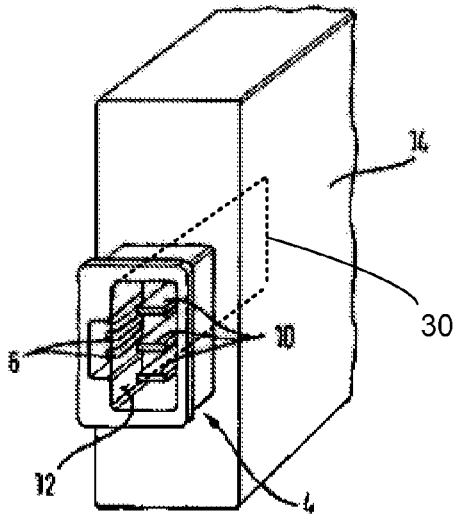
FIG. 6 is a schematic of an A.C. power connector according to another embodiment.
Figure 7:
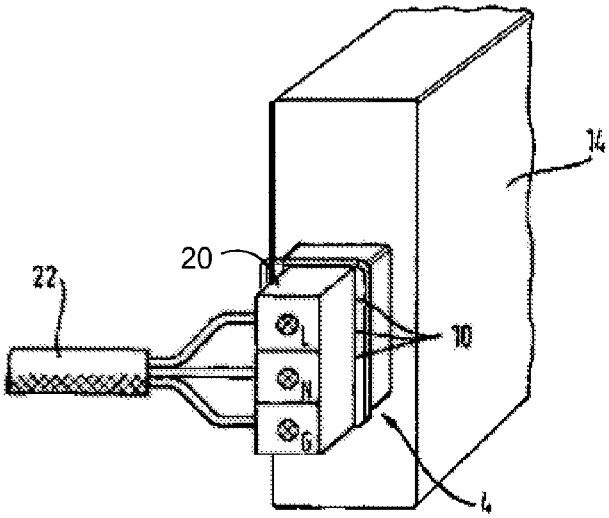
FIG. 7 is a schematic of an A.C. power connector according to another embodiment.
Figure 8A:
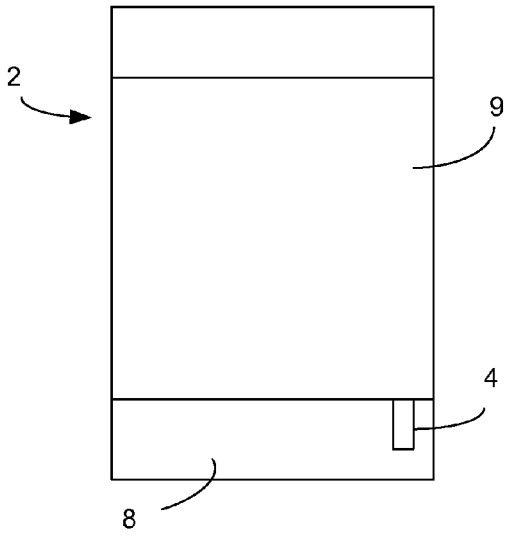
FIGS. 8A and 8B are perspective representations of the front and rear respectively of embodiments of a floor-mounted domestic appliance.
Figure 8B:
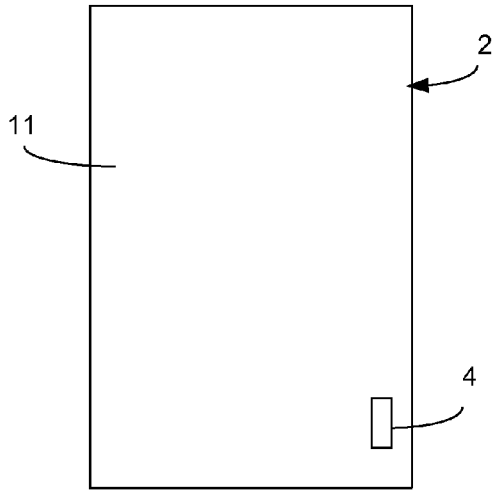

For using the data transmission contacts 6 a specially adapted appliance outlet (e.g., as shown in FIGS. 4A-4C) can be provided that has contacts 24 corresponding with the data transmission contacts 6 and thus enables contacting by means of a female A.C. power connector 4. The appliance outlet socket (e.g., 18) can therein have blindly embodied recesses 26 for the contact blades 10 so that only the data transmission contacts 6 will be contacted. The appliance outlet socket 18 can alternatively also have recessed A.C. power connector contacts 28 for the contact blades 10 so that both the data transmission contacts 6 and the contact blades 10 of the A.C. power connector 4 for supplying electric energy will be contacted and hence both the floor-mounted domestic appliance 2 will be supplied with electric energy and a data transmission will be possible via the data transmission contacts 6. That will allow programs for controlling the floor-mounted domestic appliance 2 to be loaded into the controller 14 via the data transmission contacts 6 for example while a floor-mounted domestic appliance 2 is being produced. The data transmission contacts 6 will further allow a function check to be performed on the floor-mounted domestic appliance 2 while it is being produced. Finally, the data transmission contacts 6 can, in the event of a fault instance, be used also for connecting a diagnostic device to the controller 14 in an electrically conducting manner and thus for performing a diagnosis relating to the fault instance. It is furthermore possible to use the data transmission contacts 6 for establishing a connection to a communication network such as, for example, the internet by means of a modem and thereby, in the event of a fault instance, enable a remote diagnosis to be performed and/or data relating to, for example, changed or new program cycles to be transmitted to the floor-mounted domestic appliance 2.

It can further be provided for the data transmission contacts 6 to be able to be covered and sealed by means of a suitable, e.g. plastic, cover (not shown) during production after program data has been loaded. The data transmission contacts 6 will thereby be protected while the floor-mounted domestic appliance 2 is being delivered and operated and it will not be possible for conductance bridges that could cause a fault in the controller 14 to form owing to, for example, humidity. The cover (not shown) can easily be removed by service personnel if necessary.

An appliance outlet socket 18 that has recesses 28 for accommodating the contact blades 10 and is embodied to correspond with the A.C. power connector is provided for enabling the floor-mounted domestic appliance 2 to be connected to a domestic supply network without using a plug. The appliance outlet socket 18 further has a terminal block 20 which in the present exemplary embodiment has three terminals for the phase, neutral conductor and protective conductor. The terminal block 20 therein has screw connections or other clamping connections to be able to establish an electrically conducting connection to the individual conductors of a power supply lead 22. A strain relief means (not shown) can furthermore be provided in order to avoid unnecessary mechanical loading of the connection.

The appliance outlet socket 18 having the terminal block 20 facilitates in particular installation during initial power-on that involves establishing a permanent connection to a domestic power supply network for supplying electric energy, because the appliance outlet socket socket 18 having the terminal block 20 will make it possible firstly to connect the power supply lead 22 to the terminal block 20 and, on completion of the work, to insert the appliance outlet into the A.C. power connector 4. It will hence not be necessary to duct individual wires in the power supply lead 22 to the region of the base recess 8 for establishing a contact, which action requires a corresponding body posture. The invention will therefore simplify connecting a floor-mounted domestic appliance 2 of such type to the A.C. power supply and initially powering it on.

In an embodiment, a controller 14, in particular a printed circuit board 30 thereof, can extend at least in sections into the opening of the A.C. power connector 4, which will allow a particularly compact structural design with no additional leads. For that purpose it is preferably provided for the printed circuit board 30 of the controller 14 to form, at least in sections, an interior side wall 12 of the A.C. power connector 4. A section of the printed circuit board 30 will thus seal the opening in the A.C. power connector 4. A particularly compact structural design will be possible if the data transmission contacts 6 are located on the printed circuit board 30 of the controller 16. The data transmission contacts 6 form a section of the A.C. power connector's interior side wall 12 that comes into contact with a corresponding outer surface of a matching appliance outlet socket 18 and in that way establishes a reliable connection that cannot become detached in an undesired manner even as a result of vibrations and oscillations occurring while the floor-mounted domestic appliance is operating.

The invention claimed is:

1. A floor-mounted domestic appliance comprising:

an A.C. power connector that supplies the appliance with electric energy; and an appliance outlet socket that corresponds to the A.C. power connector, wherein the appliance outlet socket comprises a terminal block for establishing an electrically conducting connection to a power supply lead;

wherein the A.C. power connector includes a socket opening and at least one data transmission contact for an extra-low electric voltage disposed in the socket opening, and wherein the at least one data transmission contact is disposed on an interior side wall of the socket opening of the A.C. power connector.

2. The floor-mounted domestic appliance of claim 1, wherein the A.C. power connector comprises an appliance connector plug.

3. The floor-mounted domestic appliance of claim 1, wherein the floor-mounted domestic appliance comprises a base recess.

4. The floor-mounted domestic appliance of claim 3, wherein the A.C. power connector is located in a region of the base recess, particularly in a region that is visible during power-on.

5. The floor-mounted domestic appliance of claim 1, wherein the A.C. power connector and appliance outlet socket are mutually detachably joined.

6. The floor-mounted domestic appliance of claim 1, wherein the A.C. power connector comprises two freestanding contact blades and the appliance outlet socket comprises a corresponding number of receptacles for receiving the two freestanding contact blades of the A.C. power connector.

7. The floor-mounted domestic appliance of claim 1, wherein the A.C. power connector supplies electric energy for electric voltage levels of domestic supply networks.

8. The floor-mounted domestic appliance of claim 1, further comprising an operating sequence controller connected in an electrically conducting manner to the at least one data transmission contact.

9. The floor-mounted domestic appliance of claim 1, wherein the at least one data transmission contact extends into the socket opening of the A.C. power connector.

10. The floor-mounted domestic appliance of claim 8, wherein the operating sequence controller extends into the socket opening of the A.C. power connector.

11. The floor-mounted domestic appliance as claimed in claim 10, wherein a printed circuit board of the operating sequence controller extends into the socket opening.

12. The floor-mounted domestic appliance of claim 11, wherein the printed circuit board of the operating sequence controller forms the interior side wall of the A.C. power connector.

13. The floor-mounted domestic appliance of claim 11, wherein the at least one data transmission contact is on the printed circuit board of the operating sequence controller.

14. The floor-mounted domestic appliance of claim 1, wherein the A.C. power connector comprises an outlet body having the socket opening and the interior side wall, wherein the terminal block is disposed in the socket opening, and wherein the interior side wall is directly adjacent to an edge of the opening of the outlet body.

15. The floor-mounted domestic appliance of claim 14, further comprising a controller connected in an electrically conducting manner to the at least one data transmission contact, wherein the controller extends into the socket opening of the body.

16. The floor-mounted domestic appliance of claim 15, wherein the controller includes a printed circuit board that extends into the socket opening, and wherein the printed circuit board forms a part of the interior side wall of the body.

17. The floor-mounted domestic appliance of claim 16, wherein the at least one data transmission contact is on the printed circuit board that forms the part of the interior side wall of the body.

18. A floor-mounted domestic appliance comprising:

a housing including a treatment space and a door on a front side of the housing, the door configured to be opened to expose the treatment space;

an A.C. power connector on the housing, the A.C. power connector supplying the appliance with electric energy; and an appliance outlet socket, the appliance outlet socket corresponding to the A.C. power connector, wherein the A.C. power connector includes an outlet body having a socket opening, wherein the appliance outlet socket comprises:

a terminal block for establishing an electrically conducting connection to a power supply lead disposed in the socket opening; and a data transmission contact for an extra-low electric voltage disposed on an interior side wall of the outlet body, the interior side wall being adjacent to an edge of the socket opening of the outlet body.

19. The floor-mounted domestic appliance of claim 18, further comprising a controller connected in an electrically conducting manner to the data transmission contact, wherein the controller extends into the socket opening of the body.

20. The floor-mounted domestic appliance of claim 19, wherein the controller includes a printed circuit board that extends into the socket opening, and wherein the printed circuit board forms a part of the interior side wall of the body.

21. The floor-mounted domestic appliance of claim 20, wherein the data transmission contact is on the printed circuit board that forms the part of the interior side wall of the body.

22. The floor-mounted domestic appliance of claim 18, wherein the A.C. power connector is on the front side of the housing.

23. The floor-mounted domestic appliance of claim 18, wherein the housing includes a base recess on the front side of the housing, and wherein the A.C. power connector is on the base recess of the front side of the housing.

24. The floor-mounted domestic appliance of claim 18, wherein the A.C. power connector is on a rear side of the housing, the rear side of the housing being opposite the front side.

* * * * *